United States Patent [19]

Stake

[11] 4,063,579

[45] Dec. 20, 1977

[54] ADJUSTABLE GUIDE FOR FEEDING BENCHES FOR EDGING MILLS

[75] Inventor: Esbjörn Åke Stake, Hudiksvall, Sweden

[73] Assignee: Aktiebolaget Iggesunds Bruk, Sweden

[21] Appl. No.: 717,059

[22] Filed: Aug. 24, 1976

[30] Foreign Application Priority Data

Aug. 25, 1975 Sweden ..... 7509438

[51] Int. Cl.[2] ..... B27C 1/12

[52] U.S. Cl. ..... 144/246 R; 144/2 R; 198/836

[58] Field of Search ..... 144/2 R, 3 P, 134 R, 144/136 R, 242 R, 246 R, 246 D, 246 E, 246 F, 247, 253 A, 312, 253 R, 253 D; 198/836; 83/102.1, 444, 446, 447, 448

[56] References Cited

U.S. PATENT DOCUMENTS

| | | | |
|---|---|---|---|
| 269,349 | 12/1882 | Tarrant | 144/253 A |
| 983,723 | 2/1911 | Johnson | 144/253 A |
| 1,320,422 | 11/1919 | Sherman | 144/253 A |
| 3,788,371 | 1/1974 | Mason | 144/312 |

FOREIGN PATENT DOCUMENTS

| | | | |
|---|---|---|---|
| 159,282 | 11/1961 | U.S.S.R. | 144/3 P |

*Primary Examiner*—Othell M. Simpson
*Assistant Examiner*—W. D. Bray
*Attorney, Agent, or Firm*—A. Yates Dowell, Jr.

[57] ABSTRACT

Adjustable guide apparatus mounted on a feeding bench for guiding a workpiece into an edging mill. The guide apparatus includes a guide member normally located above the feeding rollers of the bench for forming a guide groove in a workpiece and such guide apparatus being movable to a position substantially even with the periphery of the feeding rollers to guide the workpiece as the feeding rollers move the workpiece into the edging mills.

9 Claims, 3 Drawing Figures

ADJUSTABLE GUIDE FOR FEEDING BENCHES FOR EDGING MILLS

This invention is a device to be incorporated into feeding benches for edging mills comprising at least two stationary feeding rollers and at least two adjustable clamping cylinders between which the wood which is to be trimmed is introduced and fed into the edging mill utilizing the pressure between the cylinders and the rollers.

As is known a narrow lath is trimmed off both edges of the wood or board, its width being determined manually by the edges or automatically by an aligning and measuring device incorporating an adjustable stop which centers the board on the feeding bench prior to its being fed into the edging mill. In this regard it is vitally important that the alignment of the work piece is controlled throughout the feeding-in process and while it is being milled, otherwise the board can be fed into the mill out of alignment which causes the edges to be trimmed incorrectly and more often than not the board must be discarded.

The purpose of this invention is to provide a device incorporated into the feeding benches of the edging mills which keeps the board securely travelling in the right alignment while it is being fed into the mill and while it is being trimmed.

This is effected by the device according to the invention which incorporates the characteristics appearing in the claims below.

In the following, an embodiment of the device according to the invention is described in detail and drawings are provided.

Figure 1:
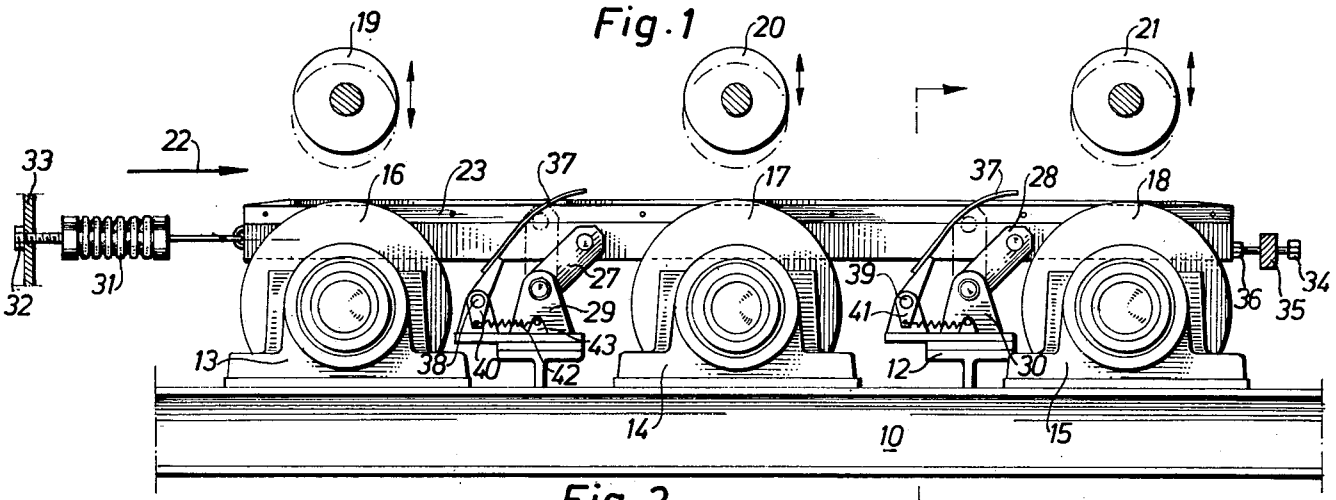
Figure 2:
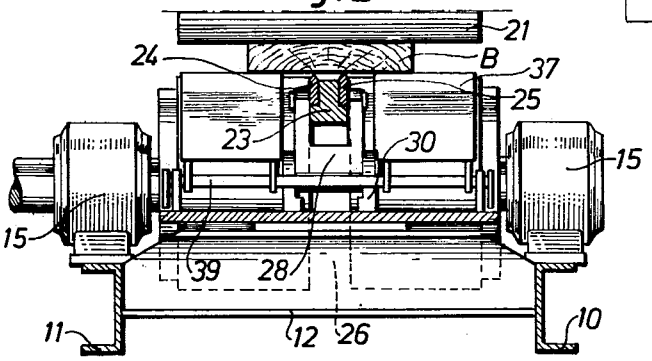
Figure 3:
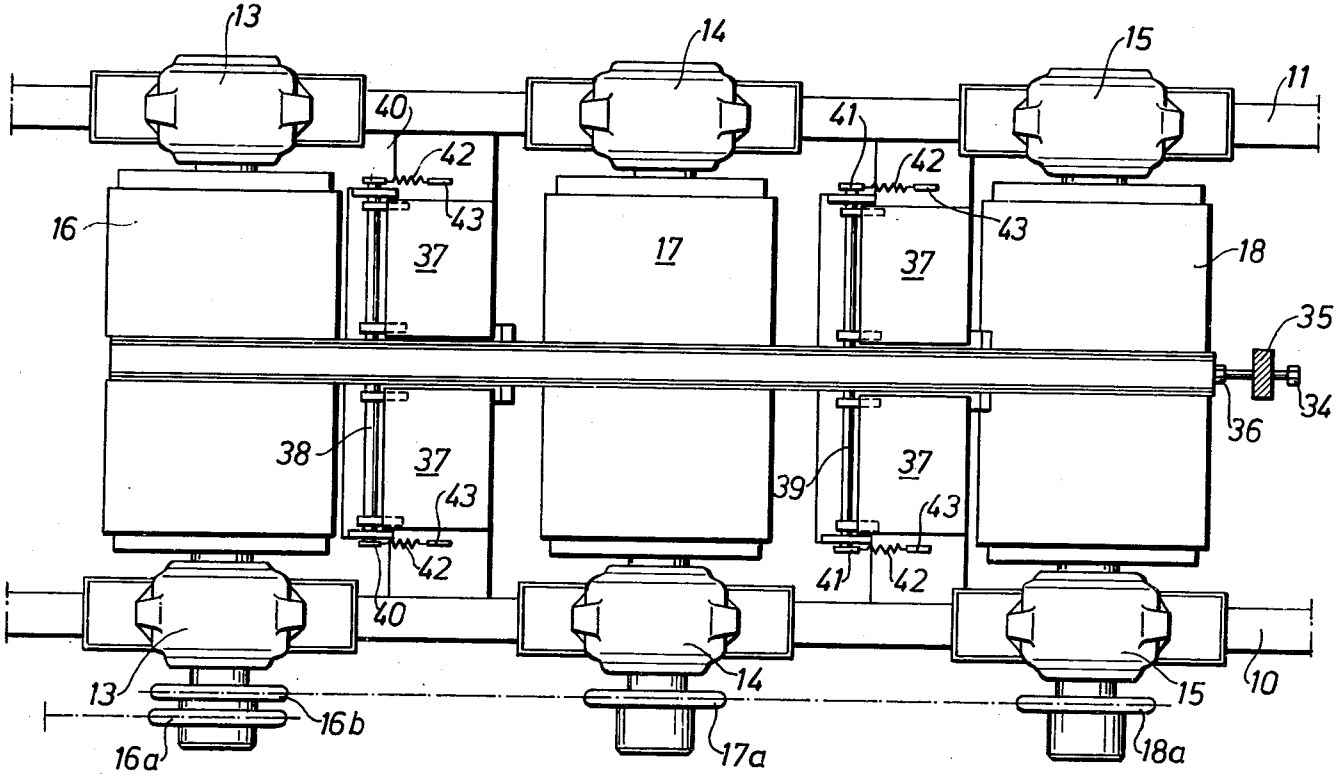

FIG. 1 is a side elevational view of the feeding bench according to the invention, while FIG. 2 shows a section along the line II—II in FIG. 1, and FIG. 3 is a plan view of the assembly shown in FIG. 1.

The feeding bench shown in FIG. 1 consists of a pair of channel beams 10, 11 joined by cross members 12 to form a frame or base. As illustrated three driven feeding rollers 16-18 are mounted in pairs of axially aligned bearing brackets 13-15 carried by the frame. The drive is passed from a motor (not shown) to a sprocket wheel **16*a* or the like (FIG. 3) mounted on the first roller's axle and from another sprocket wheel 16*b* on the same axle to sprocket wheels 17*a*, 18*a*, mounted on the axles of the remaining two rollers. The feeding rollers 16-18 are serrated or have another such surface design intended to grip and feed wood, such as board B (FIG. 2) etc, which is effected by utilizing vertically adjustable clamping cylinders 19–21 mounted above the feeding rollers in a frame (not shown). The clamping cylinders are designed to move vertically together towards and away from the feeding rollers 16-18. This is only shown diagrammatically by the arrows in FIG. 1. This motion enables the board, or the like, to be clamped between the driven, continually rotating feeding rollers 16-18 and the clamping cylinders 19-21, resulting in a feed to the right of the figure, represented by the arrow 22**.

The design described so far is similar to the design of feeding benches already known and works in such a way that the board to be trimmed or drilled from the back or side onto the feeding rollers 16-18 up to a manually or automatically adjustable stop (not shown) which centers the board on the rollers. When the clamping cylinders 19-21 are lowered onto the upper surface of the board and press it onto the driven, continually rotating feeding rollers' 16-18 serrated surface, the board B is fed into the edging mill (not shown) which is located adjacent to the feeding bench to the right hand side of FIG. 1. If at the moment of feed the board changes position so that it no longer is in line this can result in faulty milling of the edges which can mean that the board has to be discarded.

In order to remedy this the feeding bench according to the invention has a guiding device incorporating a guide bar 23 which is equipped with two generally parallel cutters 24, 25 and is arragned to run through central recesses 26 in the rollers, one of which is shown in FIG. 2. The central recess 26 in the feeding rollers 16-18 also may be provided by placing two separate rollers on the roller axles. The guide bar is vertically adjustable on two swinging arms 27, 28 which in are pivotally mounted in brackets 29, 30 on the frame's cross members 12. The guide bar normally is urged toward raised position but may be depressed against an adjustable counter pressure which can be provided in an optional manner. With reference to FIG. 1 a spring 31 is used whose power can be adjusted by a screw 32 mounted on a rigid part of the machine. At the other end of the guide bar, a stop screw 34 or similar, extends through a slot (not shown) in a rigid plate 35 on the machine and is screwed into the guide bar. Such stop screw is adjusted so that its head strikes the plate 35 on the machine when the guide bar reaches the required position and can be used as a stop to limit the upward movement of the guide bar. The stop screw is adjustable to enable the height of the guide bar to be varied depending on the operating conditions. The length of the screw thread which is screwed into the guide bar is determined by a nut 36.

Four supporting plates 37 (FIGS. 1 and 3) are arranged on both sides of the guide bar 23 between the feeding rollers. The plates are mounted in pairs on common axles 38 and 39. These axles are fitted with lever arms 40, 41 at each end, and such arms are connected by springs 42 to mounting points 43 on the machine. Such springs 42 are set so that the supporting plates 37, which are shaped to sit almost vertically at their lower ends while lying almost horizontally at their upper extremities, rest with their upper ends slightly above the guide bar 23 when a board B is lying on the supporting plates 37 and the clamping cylinders 19-21 are not lowered.

The device described works in the following way: when a board B is introduced onto the feeding bench it first rests on the supporting plates 37 which hold it slightly above the guide bar 23. Once the board B has been depressed by the clamping cylinders 19-21 the supporting plates 37 are moved downwardly against the tension of the springs 42 so that the underside of the board B comes into contact with the guide bar's cutters 24, 25, after which the guide bar is also depressed against the tension of spring 31 until the board is pressing at the pre-set force against the feeding rollers 16-18. If the counter pressure from the spring 31 is correctly set a pair of longitudinal impressions or grooves are made in the underside of the board B by the cutters 24 and 25 as the guide bar is being forced downwards, to a position on a level with the feeding roller's periphery, as is shown in FIG. 1 and 2. The guide bar cutters 24 and 25 continue to form grooves in the board B as the board is moved through the machine by the feeding rollers 16-18 and, due to the length of the guide bar, the engagement of the guide cutters 24, 25 in the grooves allows the whole of the board to be guided throughout the total feeding process with the result that it cannot run out of line on the feeding bench or through the edging mill.

It is clear that the embodiment shown and described can be altered and modified within the scope of the invention while still fulfilling its purpose. The guide bar can be made vertically adjustable in another way than that shown; the essential feature is that the guide bar is sprung for compression and that the resistance is adjustable so that the impressions can be made in the wood. Similarly the counter pressure can be provided in a way other than that shown and the stop device for the guide bar can also be modified. Naturally the device can be inverted, i.e. the guide bar can be mounted in the clamping cylinders to make impressions in the upper surface of the board.

I claim:

1. Apparatus for guiding a workpiece along an edging mill feeding bench having a frame with a plurality of spaced feeding rollers extending across the same and cooperating pressure applying means associated with the feeding rollers comprising guide bar means extending transversely of the feeding rollers and generally centrally of the frame, said guide bar means including at least one elongated guide member for engagement with the workpiece, means for movably mounting said guide bar means on the frame, said guide bar means being movable to a lowered position substantially even with the outer periphery of the feeding rollers by the pressure applying means when the pressure applying means is operated, and means for raising said guide bar means relative to the feeding rollers so that a portion of said guide member normally is located above the feeding rollers, whereby said portion of said guide member forms an elongated impression in the workpiece when the pressure applying means forces the workpiece against the feeding rollers and guides the workpiece while the feeding rollers move the workpiece along the bench.

2. The structure of claim 1 in which said means for raising said guide bar means includes resilient means connecting said guide bar means to the frame.

3. The structure of claim 2 including means for adjusting the tension of said resilient means.

4. The structure of claim 1 including stop means to limit said means for raising said guide bar means.

5. The structure of claim 1 in which said portion of said guide member has a cutting edge which engages the workpiece.

6. The structure of claim 1 in which said guide bar means includes a pair of elongated parallel guide members for engagement with the workpiece.

7. The structure of claim 1 including a plurality of supporting plates mounted on the frame, each of said supporting plates normally extending above said guide bar means and the feeding rollers in a position to support the workpiece before the pressure applying means is operated, and said supporting plates being movable to a position substantially even with the periphery of the feeding rollers so that the feeding rollers can move the workpiece.

8. The structure of claim 7 in which said supporting plates are raised and lowered by spring action.

9. A feed bench for feeding a workpiece to an edging mill comprising an elongated frame, a plurality of spaced feeding rollers having axes extending across said frame and being supported by said frame, an adustable selectively operated pressure applying cylinder associated with each of said feeding rollers, guide bar means extending transversely of the axes of said feeding rollers and generally centrally of said frame, said guide bar means having at least one elongated guide member with a cutter portion for engagement longitudinally of the workpiece, adjustable means mounting said guide bar means on said frame, said guide bar means being movable to a position substantially even with the periphery of said feeding rollers by said pressure applying cylinders when said cylinders are operated, and means for raising said guide bar means so that said cutter portion of said guide member normally is located above the periphery of said feeding rollers, whereby said cutter portion of said guide member forms an elongated impression along the length of the workpiece when the pressure applying cylinders force the workpiece against the feeding rollers and guides the workpiece while the feeding rollers move the workpiece along the bench.

* * * * *